US005901731A

United States Patent [19]

Traylor

[11] Patent Number: 5,901,731

[45] Date of Patent: May 11, 1999

[54] REVERSE OSMOSIS DRAIN COUPLING AND METHOD OF INSTALLING

[76] Inventor: Paul L. Traylor, 16591 Milliken Ave., Irvine, Calif. 92714

[21] Appl. No.: 08/801,826

[22] Filed: Feb. 14, 1997

[51] Int. Cl.[6] ..... F16K 13/10; F16L 41/16; F16L 33/06

[52] U.S. Cl. ..... 137/15; 137/247.21; 137/247.27; 285/133.11; 285/134.1; 285/252; 285/354

[58] Field of Search ..... 137/15, 247.21, 137/247.27; 4/679, 681; 285/133.11, 134.1, 242, 252, 253, 260, 354

[56] References Cited

U.S. PATENT DOCUMENTS

| | | | |
|---|---|---|---|
| 201,758 | 3/1878 | Downey | 137/247.21 X |
| 1,378,181 | 5/1921 | McGuckin | 137/247.27 |
| 1,385,220 | 7/1921 | Marquette | 285/260 X |
| 1,402,492 | 1/1922 | Grote | 285/260 X |
| 1,678,783 | 7/1928 | Oakley | 137/247.27 |
| 1,698,667 | 1/1929 | Arnold | 137/247.27 |
| 3,114,567 | 12/1963 | Colley | 285/260 X |
| 3,929,149 | 12/1975 | Phillips | 137/216 |
| 4,218,786 | 8/1980 | Taglarino | 4/679 |
| 4,263,138 | 4/1981 | Kessel | 137/247.27 X |
| 5,176,165 | 1/1993 | Traylor | 137/216.1 |
| 5,180,196 | 1/1993 | Skinner | 285/253 |
| 5,293,903 | 3/1994 | Appelwick | 137/887 |
| 5,305,778 | 4/1994 | Traylor | 137/216 |

*Primary Examiner*—John Rivell
*Attorney, Agent, or Firm*—Joseph F. McLellan

[57] ABSTRACT

A reverse osmosis drain coupling and a method of installing it in an existing drain pipe. The drain coupling includes one or more extremities made of flexible, resilient material so that the material can be rolled or folded back upon itself to shorten the coupling. The shortened coupling is inserted between the cut ends of the drain pipe, and the flexible material is then unrolled onto the adjacent cut end or ends to establish a fluid tight relation.

21 Claims, 3 Drawing Sheets

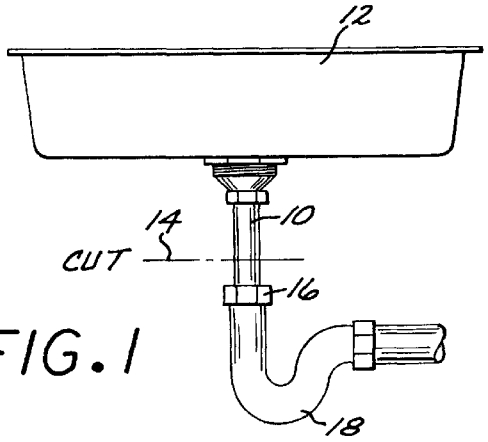
FIG. 1
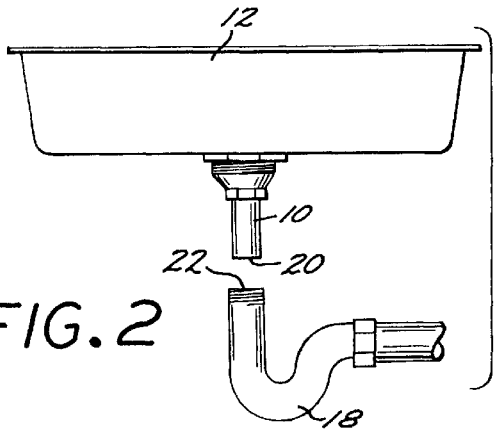
FIG. 2
FIG. 3
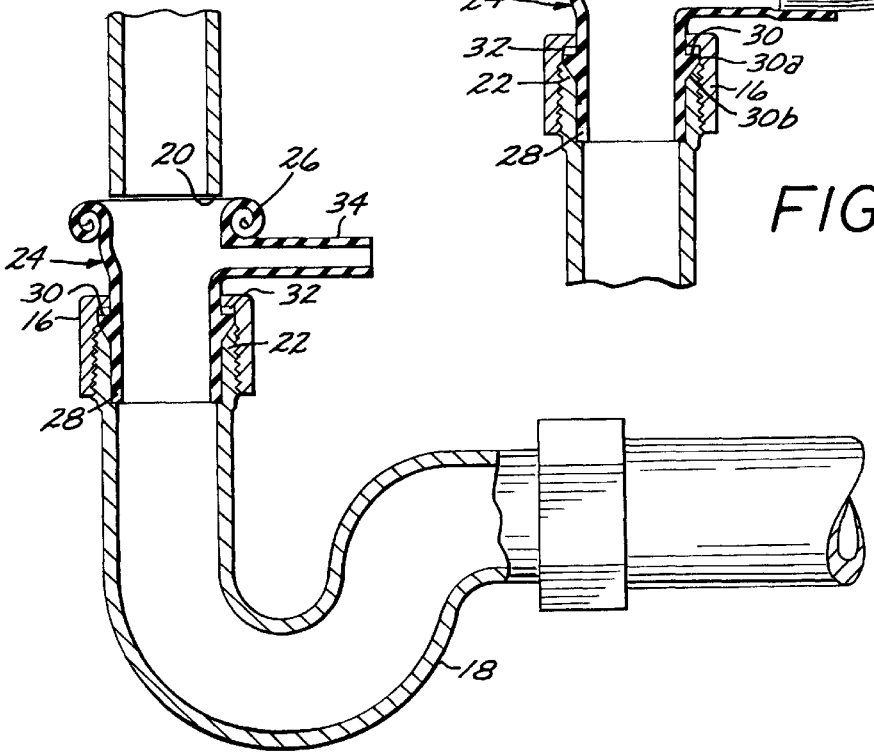
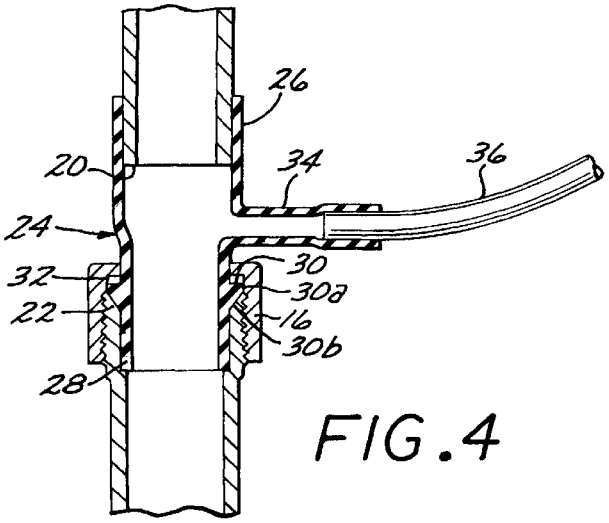
FIG. 4

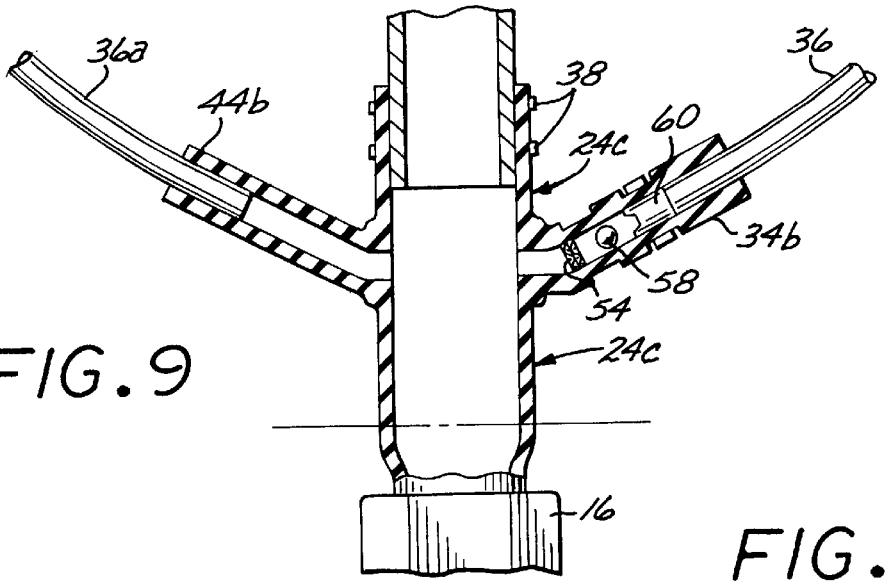
FIG. 9
FIG. 11
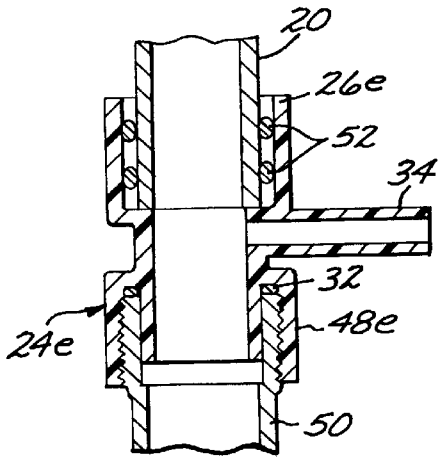
FIG. 10
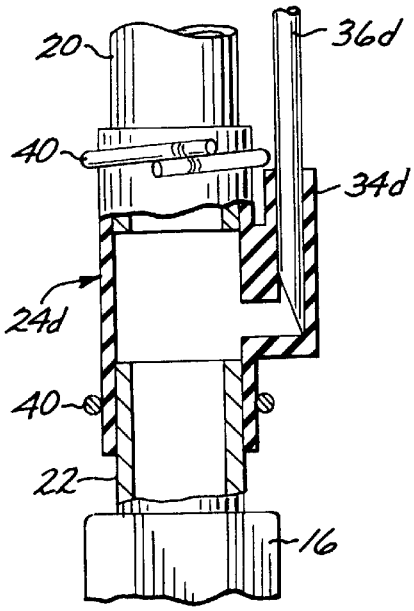
FIG. 12
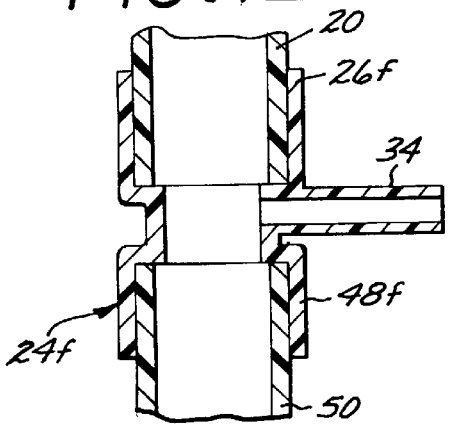

REVERSE OSMOSIS DRAIN COUPLING AND METHOD OF INSTALLING

BACKGROUND OF THE INVENTION

1. Field of the Invention

The present invention relates to a reverse osmosis (RO) drain coupling and a method of installing the coupling in a drain pipe.

2. Description of the Prior Art

When an RO drinking water unit is to be added to an existing household water supply system, it is common practice to drain the reject water through a small drain line or tube emptying into the same drain pipe that drains the sink, washing machine or garbage disposer. This is a quick and relatively inexpensive procedure.

The RO drain tube has typically been connected to the drain pipe by a cylindrical two piece saddle clamp that fits over a hole drilled in the drain pipe. The drain tube fits within a tubular protuberance or inlet port of the saddle clamp that is aligned with the drain pipe hole. A resilient pad surrounds the internal end of the inlet port fitting to provide a fluid tight seal when the two halves of the clamp are tightened together.

Plumbing codes have now largely outlawed use of the saddle clamp arrangement, ostensibly because of problems associated with the drilling of a hole in the drain pipe.

As a consequence, various proposals have been advanced in the prior art to provide for emptying of the RO drain water into the drain pipe without having to drill a special hole.

One prior art method includes the step of cutting away a section of the usually rigid drain pipe and inserting a rigid plastic T-fitting in the resulting space. Compression nuts or the like are then fitted onto the drain line and the T-fitting to secure them together. This approach results in a more costly fitting and increased installation problems.

A tubular protuberance or port of the T-fitting receives the RO drain tubing so that RO drain water does not empty into the drain pipe through a drilled hole, but instead empties into the T-fitting which discharges into the drain pipe.

SUMMARY OF THE INVENTION

According to the present invention, an RO drain tubing connection is made to a household drain pipe by cutting away a section of the drain pipe and inserting an elongated coupling between the remaining pipe ends. The coupling can be made entirely of flexible, resilient material, or one or more extremities can be made of such material.

Assuming the opposite extremities of the coupling are made of flexible material, these extremities arc folded or rolled back upon themselves to shorten the coupling for insertion between the cut pipe ends. The flexible extremities are then unrolled onto the pipe ends to provide a tight compressive squeeze and resulting fluid tight seal. If desired, additional sealing means can be provided, such as sealing rings or encircling clamps disposed over the flexible extremities and tightened in place.

Two major embodiments of the invention are disclosed. In one embodiment the coupling has one rolled back extremity and an opposite downstream extremity that is not rolled back. A single cut is made in the drain pipe at a predetermined spacing above the P-trap. The just cut adjacent pipe section, and the compression nut that was connected to the threaded portion of the P-trap, are then removed.

The downstream extremity of the coupling is adapted to mount this nut or a replacement nut, following which the coupling and nut are fitted into the space adjacent the P-trap. The nut is threaded onto the adjacent P-trap, and the flexible upstream extremity of the coupling is unrolled onto the adjacent drain pipe end.

In the second embodiment two cuts are made in the drain pipe and the intervening section is removed. In this instance a coupling is used having two flexible rolled up extremities. The coupling is inserted between the cut pipe ends, and the flexible extremities are unrolled onto the adjacent drain pipe ends.

Either method of installing the coupling is rapid and inexpensive and, in the second embodiment, can be accomplished without removing any of the existing nuts or other couplings.

Additional features relating to various sealing means, types of RO inlet ports, types of flow control or flow resistor elements, and different clamping devices for insuring fluid tight connections, are also disclosed.

Other features and advantages of the invention will become apparent from the following detailed description, taken in conjunction with the accompanying drawings which illustrate features of the invention.

BRIEF DESCRIPTION OF THE DRAWINGS

FIG. 1 is a side elevational view of a usual kitchen sink and the associated drainage system, including the vertical drain pipe from the sink;

FIG. 2 is a side elevational view similar to FIG. 1, but illustrating a cut made in the vertical drain pipe and showing the space remaining when a section of the pipe is removed, along with the usual compression nut connecting it to the P-trap;

FIG. 3 is a vertical cross sectional view on an enlarged scale illustrating a coupling according to the present invention which is inserted in the space shown in FIG. 2, and which is attached to the P-trap by means of the original compression nut;

FIG. 4 is a partial view similar to FIG. 3, but illustrating the upstream flexible extremity of the coupling unrolled from its position in FIG. 3 onto the cut end of the vertical drain pipe;

FIG. 9 is a vertical cross sectional view similar to FIG. 5, but illustrating the use of a pair of opposed RO drain tube inlet ports which are inclined upwardly relative to a horizontal axis;

FIG. 10 is a vertical cross sectional view similar to FIG. 6, but incorporating a single, vertically oriented RO drain tube inlet port to the coupling, and illustrating another form of encircling clamps disposed about the flexible extremities of the coupling;

FIG. 11 is a view similar to FIG. 4 except that one extremity of the coupling is adapted to be rolled onto the upstream end of the vertical drain pipe from the sink in combination with interior sealing rings, while the downstream extremity comprises an integrally molded nut portion adapted to be threaded upon the exposed adjacent threaded end of the drain pipe; and FIG. 12 is a view similar to FIG. 11, except that the coupling ends are dimensioned to closely receive the adjacent pipe ends in fluid tight relation.

DESCRIPTION OF VARIOUS EMBODIMENTS

Figure 5:
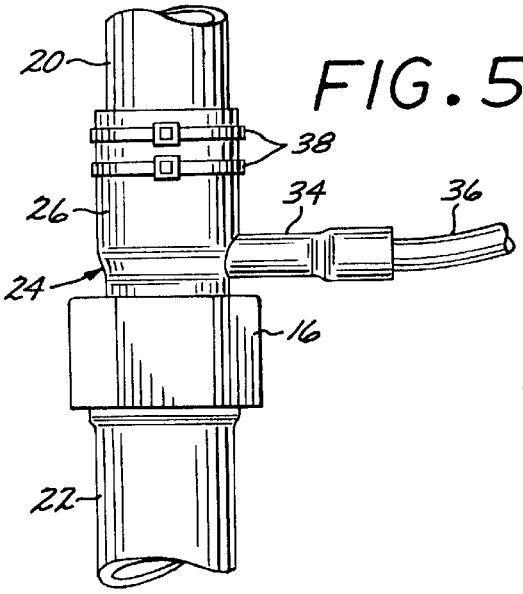
FIG. 5 is a partial elevational view similar to FIG. 4, and illustrating the additional use of a plurality of encircling clamping elements disposed about the flexible extremity to ensure a fluid tight seal with the vertical drain pipe.

Referring now to FIGS. 1–5, an embodiment of the invention is disclosed in which a single cut is made in the usual vertical drain pipe 10 of a typical kitchen sink 12. The cut is made along the phantom line 14.

According to the method of the present invention the cut section is removed, along with the usual compression nut 16 that was connected to the P-trap 18, as illustrated in FIG. 2. This may require that the P-trap be rotated slightly to more easily remove the cut section.

This procedure results in a vertically spaced apart unthreaded upstream pipe end 20 and a threaded downstream pipe end 22.

An elongated reverse osmosis (RO) coupling 24 is provided for insertion in the space between the ends 20 and 22. In the illustrated embodiment the coupling 24 includes an upstream extremity 26 that is made of any suitable flexible resilient material that is adapted to be folded or rolled back upon itself in the manner illustrated in FIG. 3. In the description and claims which follow, the term "rolled" is intended to comprehend the word "folded" as well, since both procedures operate to shorten the coupling for insertion, as will be seen.

Elastomeric materials such as rubber products are preferable for this purpose because they can easily be molded. Of course, as will be apparent to those skilled in the art, there are plastic materials that have properties very similar to rubber, and such materials could be molded with wall sections thin enough to be appropriately flexible to provide the desired flexible extremity 26.

Further, the main portion of the coupling could be made of any suitable rigid or semi-rigid material, onto which thinner wall sections of suitable plastic or rubber could be molded to provide the desired flexible extremity 26. On the other hand, the entire coupling could be made of molded flexible resilient plastic or rubber, in which case one or both extremities could be made inherently flexible and resilient by proper selection of the material and wall thickness.

For the embodiment of FIGS. 1–5, for simplicity and lowest cost it is preferred to mold the entire coupling of suitable rubber or the like which at one or both extremities is sufficiently thin that the extremity or extremities are adequately flexible and resilient so that they can be rolled back upon themselves to shorten the length of the coupling 24, as will be seen. The shortened coupling 24 is now insertable in the space existing between the separated pipe ends 20 and 22. As will be apparent, the cut 14 is properly located to provide sufficient space between the pipe ends 20 and 22 to insert the coupling 24.

The coupling 24 includes a cylindrical downstream extremity 28 adapted to be inserted within the open downstream pipe end 22. The extremity 28 includes a radially outwardly extending portion defining a circumferential shoulder 30 and further defining a circumferential side and underside 30*a* and 30*b*, respectively. Shoulder 30 serves as a seat and compression interface for the nut 16 that was previously removed from the P-trap 18. When nut 16 is tightened, a watertight seal is created along the resilient side and underside 30*a* and 30*b*, but principally along the underside 30*b*, as the shoulder expands tightly against the upper extremity of tube end 22.

The nut 16 is preferably installed by forcing it upwardly over the compliant shoulder 30. Next, a suitable load bearing washer 32 and, if desired, also a suitable sealing washer (not shown), is passed over tube end 28 and then over compliant shoulder 30. It is noted that the downstream tube end 28 fits closely within the tube end 22, which also promotes a leak tight connection. Installation of the nut 16 may require slight rotation of the P-trap 18.

If desired, the old nut 16 can be used or it could be discarded and a new nut (not shown) substituted instead. Alternatively, with the flexible coupling arrangement disclosed, the nut 16 could be installed by forcing it downwardly over the upper end 26, then over a collapsible port 34, and then onto shoulder 30. This is followed by tightening of the nut 16 onto the adjacent threaded end of the P-trap 18. Next, the flexible extremity 26 is unrolled from the rollback or retracted position illustrated in FIG. 3, to a projected position over the upstream pipe end 20, as illustrated in FIG. 4.

The coupling also includes the integral, outwardly projecting protuberance or port fitting 34 just mentioned, and the connection is completed by inserting into the fitting 34 an RO drain tube 36 which extends from the usual RO unit (not shown).

The RO drainage system is under very little if any pressure, so that the compressive resilient engagement between the flexible extremity 26 and the upstream pipe end 20 is generally sufficient to provide a fluid tight connection. However, if additional clamping means is desired, a plurality of clamping means in the form of well known cable ties 38 can be tightened in encircling relation to the drain tube connection, as seen in FIG. 5. Various other well known encircling clamping means will suggest themselves to those skilled in the art, such as usual hose clamps 40, as seen in FIG. 10, cable ties 38, or sealing tape (not shown).

Figure 7:
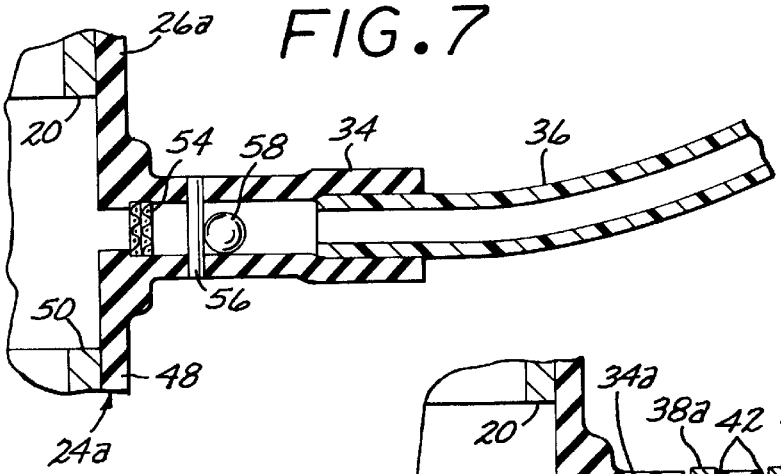
FIG. 7 is a detail cross sectional view of an inlet port to the coupling which incorporates one form of backflow prevention means.
Figure 8:
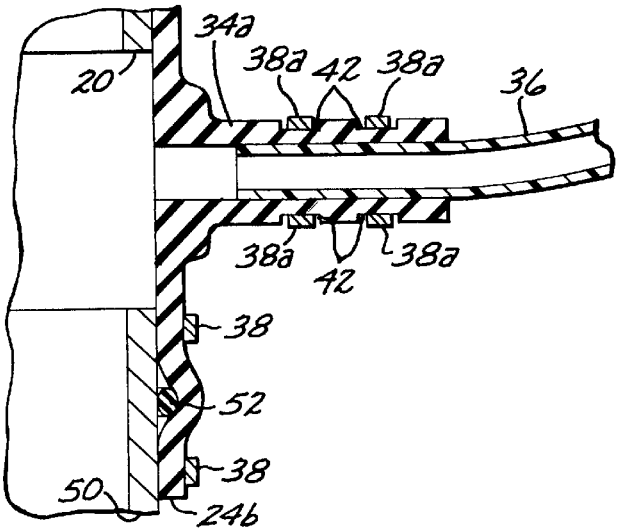
FIG. 8 is a detail view similar to FIG. 7, but illustrating a sealing or O ring used in conjunction with the clamping elements, as best seen in FIG. 5, and also illustrating another form of clamping elements used to hold the RO drain tube.

If desired, the encircling clamping means, such as the cable ties 38, can be maintained in position by seating them within grooves, such as the integrally molded grooves 42 illustrated in FIG. 8. These are used to clamp the RO drain tube 36 within the port fitting 34*a* of a similar coupling 24*b*. As was the case with the engagement between the flexible extremity 26 and the pipe end 20, a suitable leak tight fit is at the port fittings is generally achieved solely through the compressive squeeze of the port fitting upon the associated tubing, as seen in FIG. 7.

The use of "a" or "b" or the like next to a number previously used in the disclosure simply denotes a part in a closely related embodiment that is similar in operation and function to the part carrying the number.

Figure 6:
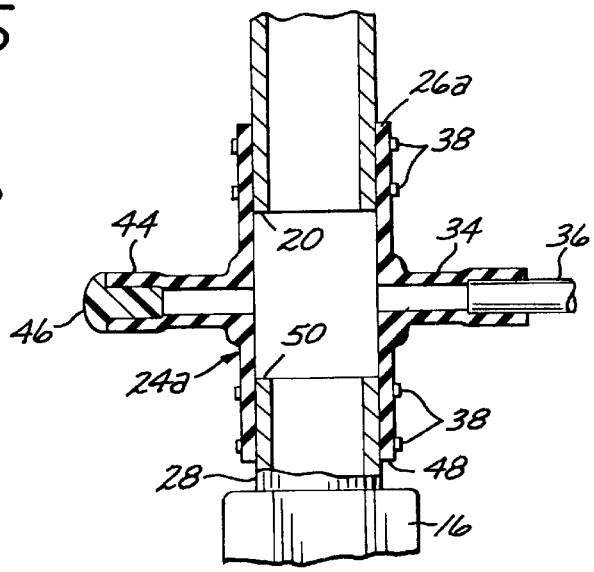
FIG. 6 is a vertical partial cross sectional view of a second embodiment of the invention in which two vertically spaced apart cuts are made in the vertical drain pipe section to enable placement therebetween of a second form of conduit having a pair of flexible extremities which are shown unrolled onto the adjacent pipe ends.

Referring now to FIGS. 6–8, a modified coupling 24*a* is disclosed which is characterized by an additional port fitting 44 identical to but oppositely disposed of the port fitting 34. The fitting 44 can be used for connection to another drain tube (not shown) for carrying additional RO drain waste, or it can be differently sized to accommodate a larger RO drain line 36, or it can be used as a vent when desired. Normally, in the usual RO drain tube installations herein disclosed, the fitting 44 is closed by a close fitting plug 46.

The port fitting 44 is useful in servicing of the coupling port 34 in the event the port 34 becomes clogged, or if a component in the port 34 has to be removed and replaced.

The modified coupling 24*a* is also characterized by a downstream flexible extremity 48 which is substantially identical to the upstream flexible extremity 26*a*. This embodiment requires that two spaced apart cuts be made in the vertical drain pipe 10, leaving the drain pipe connection to the P-trap undisturbed. This avoids the possible problem of having to remove the P-trap nut that connects it to the drain pipe. Frequently the nut is rusted to the point that it is prudent to avoid trying to remove it because it may fail altogether. In such an eventuality use of the coupling 24*a,* with its two flexible extremities 26*a* and 48, eliminates any need for removal of the nut.

With this arrangement the coupling 24*a* is placed between the cut ends of the drain pipe ends 20 and 50 with the flexible extremities 26*a* and 48 rolled up. These extremities are next unrolled onto the pipe ends 20 and 50, as seen in FIG. 6. If desired, additional clamping means in the form of cable ties 38 can be placed about the unrolled flexible extremities 26*a* and 48 that are positioned upon the pipe ends 20 and 50, respectively.

If desired, as shown in the modified coupling 24*b* of FIG. 8, the fluid tight relation of the flexible extremities upon the pipe ends can be further enhanced by using one or more sealing O-rings 52. These can be mounted upon the associated pipe end prior to unrolling the flexible coupling extremity onto the pipe. The subsequent placement of the cable ties 38 on either side of the O-ring 52 will provide extra sealing pressure on the O-rings and constrain them from shifting out of position. Another sealing means which can be used comprises a plurality of circumferential, inwardly directed ribs (not shown) that are molded integral with the interior surfaces of, for example, the ends 48 and 26*a* shown in FIG. 6. These tend to seal in a manner similar to the sealing action of the O-rings 52.

FIG. 7 illustrates the use of a pair of screens 54 integrally incorporated in the inner extremity of the fluid passageway of the port fitting 34. The number and size of screen interstices can be selected to screen out particles and debris that are normally found in the sink drain pipes, and keep them from blocking or clogging the conduit 36. Provision of this screening is an important feature in that it solves many clogging problems existing in the prior art structures. Preferably they are located as far downstream as possible to intercept backflowing debris before it reaches the RO system.

If desired, a means can also be incorporated in the port fitting 34 to limit back flow from the coupling 24*a* into the drainage line coming from the RO unit (not shown). Such a means preferably takes the form of a backflow resistor comprising a transverse pin or element 56 molded or pressed into a suitable pair of opposed holes provided in the port fitting 34. A valve or ball 58 is located upstream of the element 56. Either the element 56 or screens 54 can operate to keep a valve or ball 58 confined within its chamber. However, in the event of a backflow, the ball 58 will be urged into substantially sealing relation with the adjacent formed or seat end of the RO drain tube 36 or, if used, the seat defined by an element 60.

FIG. 9 illustrates a coupling 24*c* in which the oppositely located port fittings 34*b* and 44*b* extend upwardly from the coupling at an inclined angle, which is advantageous in certain applications. The coupling 24*c* is also characterized by use of the screens 54 to prevent movement of the ball 58 into the main body of the coupling 24*c,* as compared with the pin 56 of the embodiment of FIG. 7. Preferably, a formed seat 60 is located upstream of the ball 58 so that the ball can more precisely and effectively fit against it to block undesired backflow, as compared with seating against the end of the drain tube 36.

FIG. 10 illustrates yet another arrangement for the port fitting, in this case the port fitting 34*d* extends from the coupling main body a short distance, and is then vertically oriented to conveniently receive a vertically oriented drain tube 36*d,* as illustrated.

With reference to FIG. 11, a related embodiment is illustrated comprising a coupling 26*e* which is preferably made entirely of resilient flexible material, and which includes flexible extremities 26*e* and 48*e*. Only one cut is made in the drain pipe 10, leaving an upstream pipe end 20 and a threaded downstream pipe end 50 after the P-trap nut 16 has been removed. After the coupling 26*e* is placed in position between the pipe ends, the upstream flexible extremity 26*e* is unrolled over a pair of vertically spaced apart sealing means or O-rings 52 that were previously placed over the pipe end 20 as illustrated. This arrangement provides a good seal at the pipe/flexible extremity interface.

The opposite flexible extremity 48*e* includes integral molded in threads adapted upon unrolling of the extremity 48*e* to closely mate in sealing relation with the threads of the downstream pipe end 50. If desired, a sealing or bearing washer 32, or both, can be interposed between these parts to further ensure a good seal.

FIG. 12 illustrates an arrangement which is similar to that of FIG. 11, but without internal threads in the lower coupling end, and in which the inner diameter of the flexible extremities 26*f* and 48*f* is made large enough to define inner circumferential shoulders upon which the ends of the pipes 20 and 50 can engage for improved sealing once the tightly fitting extremities are unrolled onto the pipe ends.

With respect to the coupling illustrated in FIG. 6, the combination of ports 34 and 44 provide certain options for the user. More particularly, whether the associated RO unit is operating or has been removed for some reason, the coupling can be left in place and the ports 34 and 44 suitably plugged. The plug can be in the form of a loop of tubing (not shown) which is inserted at its opposite ends in the ports 34 and 44, leaving the coupling fully functional as a part of the drain system.

Such an arrangement is also useful in the event of a drain stoppage. The tube can be removed from the port 44 to allow water that has backed up into the sink to be drained away through the port and into a suitable container pending correction of the drain stoppage problem. If desired, the port 44 can thereafter again be plugged, and drain cleaner can be poured into the sink for passage into the drain system through the coupling. From there the cleaner can flow to and beyond the P-trap, where most drain clogging tends to take place. The open or unplugged port 44 also allows passage of a wire or the like (not shown) to and beyond the P-trap to help clear the clog.

With the foregoing arrangement it is seen that the present drain coupling and associated method of installing it provide a plumbing code approved type of connection that is quick and easy to install for draining an RO unit, and without any need to drill a hole in the existing drain piping. While several forms of the invention have been illustrated and described, it will be apparent that various modifications can be made without departing from the spirit and scope of the invention.

What is claimed is:

1. A reverse osmosis drain coupling for location between spaced apart first and second ends of a drain pipe, the drain coupling comprising:

a first extremity made of flexible resilient material capable of being rolled back upon itself from a projected position to a rollback position to shorten the coupling for location between the first and second ends whereby the first extremity can subsequently be unrolled to its projected position and onto the first end, the coupling further including a first inlet port in communication with the interior of the coupling for connection to a reverse osmosis drain tube.

2. A drain coupling according to claim 1 wherein the second end of the drain pipe is threaded, and the coupling includes a second extremity having means for threaded connection of the coupling to the threaded second end.

3. A drain coupling according to claim 2 wherein the threaded second end of the drain line carries a nut, and the last mentioned means is engageable by the nut.

4. A drain coupling according to claim 3 wherein the last mentioned means includes a sealing means for engagement by the nut.

5. A drain coupling according to claim 1 and including a second inlet port in communication with the interior of the coupling.

6. A drain coupling according to claim 5 and including means for selectively blocking the second port against fluid flow therethrough.

7. A drain coupling according to claim 1 and including clamping means for encircling the first extremity and the first end to provide a fluid tight seal between the first extremity and the first end.

8. A drain coupling according to claim 1 wherein the first port includes a flow limiter for regulating the rate of fluid flow into the coupling.

9. A drain coupling according to claim 1 wherein the first port includes a back flow resistor for substantially blocking backflow from the coupling into the first port.

10. A drain coupling according to claim 9 wherein the back flow resistor comprises a seat, a ball located downstream of the seat, and a screen located downstream of the ball.

11. A drain coupling according to claim 1 where all of the coupling is made of flexible and resilient material.

12. A drain coupling according to claim 11 wherein the first port extends upwardly at an angle to the longitudinal axis of the coupling.

13. A drain coupling according to claim 11 wherein the first port extends outwardly and then vertically upwardly.

14. A reverse osmosis drain coupling for location between spaced apart first and second ends of a drain pipe, the drain coupling being made of flexible resilient material and comprising:

a first extremity and an opposite second extremity, each capable of being rolled back upon itself from a projected position to a rollback position to shorten the coupling for location between the first and second ends whereby the first and second extremities can subsequently be unrolled onto the first and second ends, respectively, the coupling further including a first port in communication with the interior of the body and adapted for connection to a reverse osmosis drain tube.

15. A drain coupling according to claim 14 and including a second inlet port in communication with the interior of the body.

16. A drain coupling according to claim 14 and including first and second clamping means for encircling the first and second flexible extremities and the first and second ends, respectively, to provide a fluid tight seal between the first and second flexible extremities and the first and second ends.

17. A drain coupling according to claim 14 and including seal ring means within the first extremity for sealing engagement with the first end, and wherein the second end of the drain pipe is externally threaded and the second extremity is internally threaded for threaded connection of the body to the threaded second end.

18. A method of installing a reverse osmosis drain coupling in a drain pipe comprising the steps of:

cutting out a section of the drain pipe to provide a pair of spaced apart first and second ends;

selecting an elongated coupling made of flexible and resilient material and having a first extremity capable of being rolled back upon itself from a projected position to a rollback position to shorten the coupling;

locating the shortened coupling between the first and second ends; and unrolling the first extremity onto the first end.

19. A method according to claim 18 wherein the second end is threaded, and including the further step of threading the second extremity onto the second end.

20. A method according to claim 18 wherein the coupling includes an opposite second extremity, and including the step of unrolling the first and second extremities onto the first and second ends, respectively.

21. A method according to claim 20 and including the further step of placing clamping means around the first and second extremities to establish a fluid tight relation between the first and second extremities and the first and second ends, respectively.

* * * * *